United States Patent [19]

Hammock

[11] 4,384,562

[45] May 24, 1983

[54] FUEL PUMPING APPARATUS

[75] Inventor: Michael T. Hammock, Holmer Green, England

[73] Assignee: Lucas Industries Limited, Birmingham, England

[21] Appl. No.: 197,904

[22] Filed: Oct. 17, 1980

[30] Foreign Application Priority Data

Nov. 2, 1979 [GB] United Kingdom ..... 7938100

[51] Int. Cl.[3] ..... F02M 39/00

[52] U.S. Cl. ..... 123/502; 123/179 L

[58] Field of Search ..... 123/179 L, 502, 501, 123/500; 417/253

[56] References Cited

U.S. PATENT DOCUMENTS 3,815,569 6/1974 Suda ..... 123/501

4,214,569 7/1980 Skinner ..... 123/179 L

FOREIGN PATENT DOCUMENTS 2345724 3/1974 Fed. Rep. of Germany ..... 123/502

*Primary Examiner*—Charles J. Myhre

*Assistant Examiner*—Carl Stuart Miller

[57] ABSTRACT

A liquid fuel injection pumping apparatus includes a fluid pressure operable piston coupled to a timing component of the apparatus. A first spring is provided to bias the piston towards a retard position. A pair of abutments are provided at the ends of the first spring and adjusting means is provided to determine the spacing of the abutments. The adjusting means is controlled by a first control means the setting of which is varied with temperature. A second spring acts on the piston and is located between one of the abutments and the piston and second control means adjusted in accordance with the setting of the fuel control of the apparatus, is provided to determine the axial setting of the adjusting means.

5 Claims, 7 Drawing Figures

FIG.3.
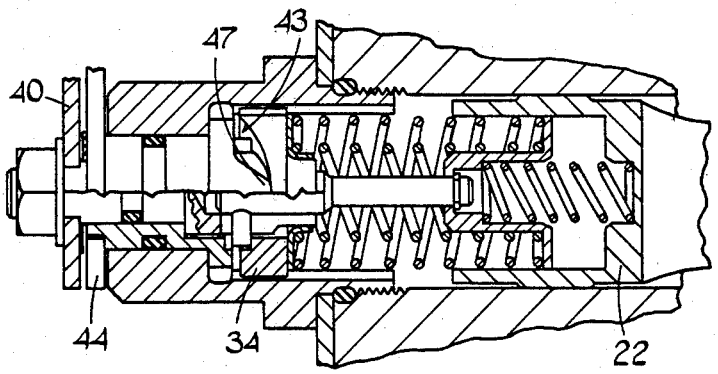
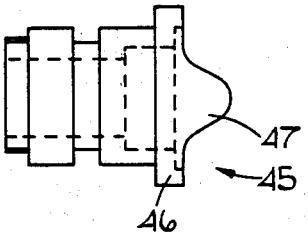
FIG.4.
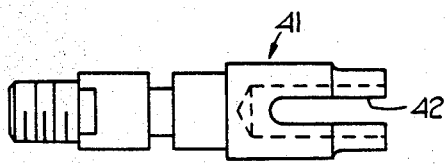
FIG.5.
FIG.6.
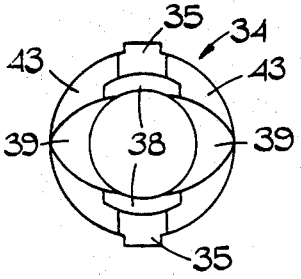
FIG.7.
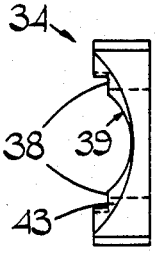

FUEL PUMPING APPARATUS

This invention relates to a liquid fuel injection pumping apparatus for supplying fuel to an internal combustion engine and of the kind comprising an injection pump which in use is driven in timed relationship with the associated engine, the apparatus including a component which is movable to vary the timing of delivery of fuel by the injection pump, a low pressure supply pump for supplying fuel to the injection pump, fuel control means for varying the quantity of fuel delivered by the injection pump, valve means for controlling the output pressure of the supply pump so that it varies in accordance with the speed of the associated engine, a fluid pressure operable piston responsive to the output pressure of the supply pump and means for coupling said piston to said component so that the movement of said piston is transmitted to said component.

Where the engine is a compression ignition engine it is necessary for the efficient starting and operation thereof that the setting of said component should be such that:

(a) The timing of delivery of fuel should advance with increasing speed, (b) The timing of delivery of fuel should advance as the load on the associated engine decreases for a given speed, (c) The timing of delivery of fuel can be retarded beyond that achieved during normal running for starting the engine when cold, (d) The timing of delivery of fuel should be advanced from the setting in c when the engine is cold and is required to idle, and (e) The retarding of the delivery of fuel to a setting between c and d when the engine is hot and is required to idle.

The object of the invention is to provide an apparatus of the kind specified in a form in which the above desiderata are achieved.

According to the invention an apparatus of the kind specified comprises a cylinder in which said piston is slidable, passage means through which one end of the cylinder is in communication with the outlet of the low pressure pump, first resilient means located in the other end of said cylinder, first and second abutment means engaged with the ends respectively of said first resilient means, adjustment means which can act between said first and second abutment means to determine the maximum distance between said abutment means, first control means operable to adjust the setting of said adjustment means, second control means operable to adjust the position of said second abutment means depending upon the load on the associated engine and second resilient means for moving the piston to a retard position for starting purposes, the fluid pressure acting on said piston initially moving said piston against the action of said second resilient means and then against the action of said first resilient means as the pressure applied to said piston increases.

An example of a fuel pumping apparatus in accordance with the invention will now be described with reference to the accompanying drawings in which:

FIG. 3 is a section similar to FIG. 2 showing the various parts in an alternative position, FIGS. 4–7 are views of parts of the apparatus seen in FIGS. 2 and 3.

Figure 1:
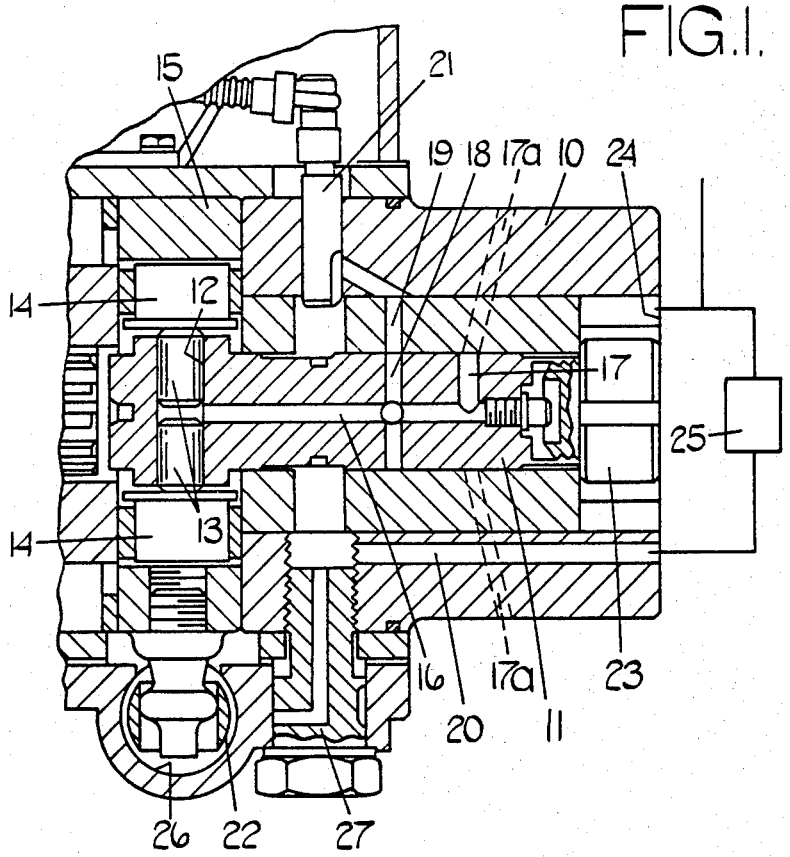
FIG. 1 is a sectional side elevation through the apparatus.

With reference to FIG. 1 of the drawings the apparatus comprises a body part 10 in which is mounted a rotary cylindrical distributor member 11. The distributor member is connected to a shaft whereby it can be driven in timed relationship with an associated engine. Formed in the distributor member is a transversely extending bore 12 in which is mounted a pair of plungers 13. The plungers at their outer ends engage cam followers 14 which include rollers engageable with the internal peripheral surface of an angularly adjustable cam ring 15.

The bore 12 communicates with a longitudinal passage 16 formed in the distributor member and which communicates with a radially extending delivery passage 17. The passage 17 can communicate in turn as the distributor member rotates, with a plurality of outlets **17*a* formed in the body part 10** and which in use are connected to the injection nozzles respectively of the associated engine.

The passage 16 also communicates with a plurality of radially disposed inlet passages 18 which are adapted to register with an inlet port 19 the latter being formed in the body part. Also located in the body part is a fuel control means in the form of a throttle member 21 through which fuel flowing through a passage 20 can flow to the inlet port 19. The passage 20 communicates with the outlet of a low pressure supply pump 23 which has an inlet 24. The rotary part of the pump 23 is driven from the distributor member 11 and the inlet and outlet of the supply pump are interconnected by a relief valve 25 which acts to control the output pressure of the supply pump so that it varies in accordance with the speed at which the apparatus is driven.

The plungers 13 constitute the pumping elements of an injection pump and with the parts in the positions indicated in FIG. 1, fuel is being supplied from the supply pump 23 by way of the passage 20, the throttle member 21 and the inlet port 19 to the bore 12. As the distributor member rotates the communication of the inlet port with one of the inlet passages is broken and the passage 17 is brought into register with one of the outlets **17*a*. Inward movement is now imparted to the plungers by way of the cam followers, 14 by means of cam lobes formed on the internal peripheral surface of the cam ring. The plungers are moved inwardly and fuel is displaced through an outlet 17*a* to the associated fuel injection nozzle. The cycle is repeated as the distributor member is further rotated and the quantity of fuel which is supplied to the engine is determined by the setting of the throttle member 21**.

It is required to adjust the timing of delivery of fuel to the associated engine and for this purpose a component of the apparatus is adjustable. In this case the component is the cam ring 15 which is angularly adjustable within the body part and which for this purpose, is connected by means of a radially disposed peg to a piston 22 which is located within a cylinder 26 this being formed in a part which is secured to the body part 10 by means of a bolt 27 which conveniently provides a fuel connection from the passage 20. There is incorporated in the connection between the passage 20 and the cylinder 26 a check valve the purpose of which is to prevent movement of the piston 22 when a reaction force is applied thereto, the reaction force being created by the engagement of the rollers 14 with the cam lobes.

Figure 2:
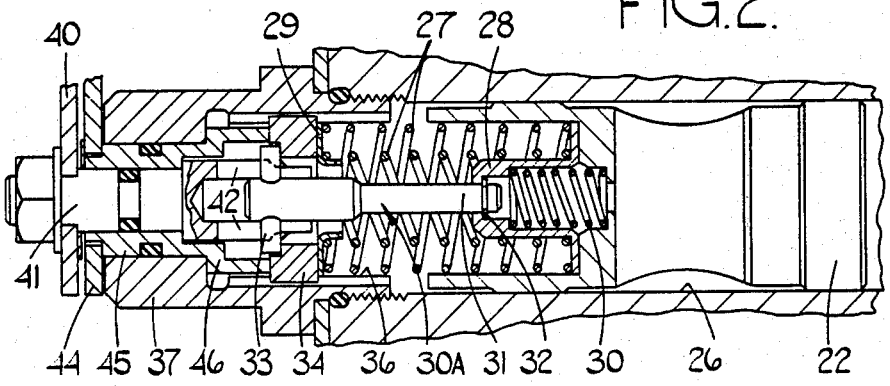
FIG. 2 is a section through a part of the apparatus seen in FIG. 1.

Turning now to FIG. 2 the piston 22 is biassed in a direction to retard the timing of delivery of fuel by first and second resilient means. The first resilient means comprises a pair of coiled compression springs 27 the opposite ends of which engage first and second spring abutments 28, 29 respectively. The second resilient means takes the form of a coiled compression spring 30 which is located between the abutment 28 and the piston 22.

Adjustment means generally indicated at 30A is provided to determine the maximum axial distance between the abutments 28 and 29. The adjustment means takes the form of a rod 31 which extends freely through an aperture formed in the abutment 28, the rod being provided with a circlip 32 which is engageable with a portion of the abutment surrounding the aperture. The other end of the rod 31 is provided with a transversely extending pin 33. The adjustment means also includes an annular member 34 the construction of which is more clearly seen from FIGS. 6 and 7. As will be seen from these figures the annular member is provided with a pair of outwardly extending projections 35 and these projections are engaged within axially extending grooves 36 formed in the internal wall of a generally cylindrical end closure 37 for the end of the cylinder 26. Conveniently and as shown, the end closure is provided with a threaded portion which is engaged with complementary screw threads formed in the end of the cylinder 26. The annular member 34 by reason of the projections is prevented from moving angularly but is able to move axially.

The face of the annular member 34 remote from the abutment 29 is divided into inner and outer zones. The inner zone includes a pair of ledges 38 which are diametrically disposed and which in the particular example, are aligned with the projections 35. Between the ledges 38 the inner zone defines recesses 39 which are of a semicylindrical nature. In FIG. 2 the pin 33 is shown to be on the ledges 38 but it is movable angularly to a position in which it is located within the recesses 39 by a first control means which includes a lever 40 mounted on an angularly adjustable member 41 which has a tubular end portion in which are formed a pair of slots 42 within which the pin 33 is located. The lever 40 is conveniently connected to a control whereby it is moved from the position shown in FIG. 2 to the position in which the pin 33 is located in the recesses 39 when it is required to start the engine when the latter is hot. The effect of this movement is to permit the springs 27 to move the abutments 28 and 29 further apart in the axial direction. The piston 22 will, by virtue of the spring 30, already be in the full retard position.

The aforesaid outer zone of the face of the annular member 34 remote from the springs 27 defines a pair of cam profiles 43. A second control means is provided and this includes a lever 44 which is mounted on an annular member 45 which is journalled within the end closure 37, and which also serves to support the member 41. The member 45 as more clearly seen in FIG. 4, has a flange portion 46 which engages a step defined in the end closure 37, the step acting to determine the axial position of the member 45. Extending from the flange 46 are a pair of contoured projections 47 which engage with the cam profiles 43 respectively. The angular setting of the member 45 is varied in accordance with the setting of the throttle 21 and for this purpose the lever 44 is coupled by means of linkage (not shown) to the operating linkage of the throttle member 21.

The operation of the piston 22 will now be described. In FIG. 2 the spring 30 is shown as being fully compressed and this degree of compression is achieved by the time the speed of the engine after starting, has attained its idling speed. Thus when starting, the piston will be at its extreme right position and the timing of delivery of fuel will be fully retarded.

In both FIGS. 2 and 3 the lever 40 is set in the cold idle position to which position it would be moved either by the operator or by a temperature responsive device. The pin 33 is located on the ledges 38. The springs 27 are therefore compressed their maximum extent, by the action of the adjusting means.

If the engine is hot then the lever 40 will have been moved through substantially 90° from the position shown in FIG. 2 either by the operator or the temperature responsive device and the pin 33 will be located in the recesses 39. As compared with the position shown in FIG. 2 the springs 27 will have moved the piston towards the right to retard the timing although it will be understood that if the engine is at rest the piston will be in the fully retard position by virtue of the action of the spring 30.

The load on the engine is represented by the amount of fuel delivered to the engine at each injection stroke and the amount of fuel delivered is determined by the setting of the throttle 21. As the amount of fuel delivered to the engine is increased by movement of the throttle the lever 44 is moved from the position in which it is shown in FIG. 3 to the position in which it is shown in FIG. 2. The projections 47 on the member 45 rise up the cam profiles 43 which has the effect of moving the member 34 together with the springs 27 and the piston towards the right to retard the timing of the delivery of fuel to the engine. Conversely as the load is reduced the lever 44 moves from the position in which it is shown in FIG. 2 to the position in which it is shown in FIG. 3 and the piston moves towards the left and the timing is advanced.

It will be understood that in FIGS. 2 and 3 the length of the springs 27 is shown to be determined by the adjusting means 30A. When the speed of the engine increases the force acting on the piston increases and at values of speed which will depend on whether the pin 33 is on the ledges 38 or in the recesses 39, the preload of the springs 27 will be overcome and the piston will move to the left thereby advancing the timing of delivery of fuel. The maximum advance is determined by the abutment of the end of the skirt of the piston 22 with the end closure 37.

I claim:

1. A liquid fuel injection pumping apparatus for supplying fuel to an internal combustion engine and comprising an injection pump which in use is driven in timed relationship with the associated engine, the apparatus including a component which is movable to vary the timing of delivery of fuel by the injection pump, a low pressure supply pump for supplying fuel to the injection pump, fuel control means for varying the quantity of fuel delivered by the injection pump, valve means for controlling the output pressure of the supply pump so that it varies in accordance with the speed of the associated engine, a fluid pressure operable piston responsive to the output pressure of the supply pump, means for coupling said piston to said component so that the movement of the piston is coupled to said component, a cylinder in which said piston is slidable, passage means through which one end of the cylinder is in communication with the outlet of the low pressure pump, first resilient means located in the other end of said cylinder, first and second abutment means engaged with the ends respectively of said first resilient means, adjustment means which can act between said first and second abutment means to determine the maximum distance between said abutment means, said adjustment means comprising a rod member slidable within said first abutment means, means carried by the rod for engagement with said first abutment means, and first and second members engaged with the rod and said second abutment means respectively, said first and second members being relatively angularly movable, and surfaces on the members whereby when the members are moved angularly relative axial movement will take place therebetween, first control means operable to adjust the setting of said adjustment means, second control means operable to adjust the position of said second abutment means depending upon the load on the associated engine, and second resilient means for moving the piston to a retard position for starting purposes, the fluid pressure acting on said piston initially moving said piston against the action of said second resilient means and then against the action of said first resilient means as the pressure applied to said piston increases.

2. An apparatus according to claim 1 in which said second member is of annular form, a projection extending outwardly from the member, means defining an axial groove in said cylinder, said projection engaging in said groove to prevent angular movement of said second member, said first member being in the form of a pin extending transversely of the rod and engaging the surface of the second member remote from the first resilient means, said first control means engaging with the pin to impart angular movement to the rod.

3. An apparatus according to claim 2 in which said second control means defines a flange portion, a pair of projections on the flange, said projections extending axially towards said second member, and cam profiles on said second member for engagement with said projections whereby upon angular movement of said second control means axial movement will be imparted to said second member.

4. An apparatus according to claim 3 including linkage connecting said second control means to said fuel control means.

5. An apparatus according to claim 4 or claim 4 in which said first control means is coupled to a temperature responsive device.

* * * * *